United States Patent [19]

Schmidt, Sr. et al.

[11] 3,937,356

[45] Feb. 10, 1976

[54] SANITARY RAIL STRUCTURE FOR FOOD PRODUCTS VESSEL

[76] Inventors: Jacob Schmidt, Sr.; Jacob Schmidt, Jr., both of R.D. No. 1, Harleysville, Pa. 19438

[22] Filed: Apr. 10, 1975

[21] Appl. No.: 566,741

[52] U.S. Cl. ..... 220/73; 220/4 R

[51] Int. Cl.[2] ..... B65D 7/42

[58] Field of Search ..... 220/73, 74, 4 R, 4 A, 4 B

[56] References Cited

UNITED STATES PATENTS

| | | | |
|---|---|---|---|
| 1,474,601 | 11/1923 | Miller | 220/74 |
| 2,615,593 | 10/1952 | Wolforth | 220/73 |
| 2,625,289 | 1/1953 | Murphy | 220/74 |
| 2,656,066 | 10/1953 | Riemenschneider | 220/74 |
| 3,780,903 | 12/1973 | Clarkin et al. | 220/73 |

FOREIGN PATENTS OR APPLICATIONS

| | | | |
|---|---|---|---|
| 289,210 | 4/1928 | United Kingdom | 220/73 |

*Primary Examiner*—Donald F. Norton
*Assistant Examiner*—Joseph M. Moy
*Attorney, Agent, or Firm*—C. Hercus Just; Samuel M. Learned, Jr.

[57] ABSTRACT

A rectangular shaped food products storage and transfer vessel having an integral sanitary top rail structure triangular in cross-section and formed by being bent downward from the upper edges of the respective side-wall panels of the vessel, the lowermost depending edges of the rail members thus formed being joined to the upper external sidewalls of the vessel by means of a continuous exposed weld and the sidewall rail structure terminal positions at the respective upper external corners of the vessel being closed by separately formed corner members weldably affixed thereto to form a continuous closed rail structure about the upper open periphery of the vessel and thereby provide an easily cleanable reinforced protective top edge member for the vessel.

1 Claim, 6 Drawing Figures

SANITARY RAIL STRUCTURE FOR FOOD PRODUCTS VESSEL

BACKGROUND OF THE INVENTION

The present invention relates to a sanitary rail structure for a food products storage and transfer vessel such as is commonly employed in the poultry and meat processing industries during butchering, boning, trimming, and packing operations. It should be pointed out that the term "sanitary rail structure," as herein used, is employed to denote a closed continuous reinforcing rim member extending around the open peripheral edge of a food products vessel.

In view of the present stringent government regulations imposed upon the food processing industry for maintaining sanitary conditions, as well as the continual scrutiny of food processing operations by government sanitation inspectors, it is incumbent upon the industry to utilize processing equipment which may be easily cleaned and maintained in a sanitary condition at all times. Traditionally, food processing equipment is fabricated from polished stainless steel, which has the advantages of being corrosion resistant, structurally strong, and easily cleaned and maintained. In addition, food containing vessels and container equipment are generally provided with a reinforcing edge structure about the open end, which structures are usually either of the so-called "rolled rim" or "bar rail" types.

The rolled rim type of reinforced edge structure used at present is integral with the vessel and is formed integrally from the sidewall material thereof by bending the upper peripheral edge material of the vessel outward, downward and inward toward the side walls to produce either a rounded semicircular structure open on the underside thereof, or, bending the edge material further around to abut the sidewalls and form a tubular structure wherein the leading edge thereof is weldably connected to the external sidewall of said vessel, thereby providing a continuous closed rim about the open end of said vessel. In either case however, both the semicircular and closed tubular rolled rim structure configurations have the disadvantage of providing a lower surface which is conducive to the collection and accumulation of food processing waste and contaminants thereon, as well as said surface not being easily accessible for purposes of cleaning. In addition, the leading edge of the closed tubular rolled rim structure configuration is not easily accessible for weldably connecting the same to the external sidewall of the vessel, and a cracked or faulty weld is unacceptable in that it provides crevices wherein food processing waste and contaminants collect and thereby prevent obtaining the necessary sanitary features which are required.

The bar rail type of reinforced edge structure used at present is fabricated by weldably affixing a rectangular tubular bar about the open peripheral edge of the food storage and transfer vessel, which requires two welds, one of which connects the upper peripheral outer edge of said vessel to the upper vessel-side corner of the bar, and the other of which connects the lower vessel-side corner of the bar to the vessel sidewall. In the bar rail reinforced edge structure, as was also the case with the rolled rim structure, there is a lower surface which is conducive to the collection and accumulation of food processing waste and contaminants thereon, as well as said surface not being easily accessible for cleaning. Likewise, the lower vessel-side corner of the bar rail members adjacent the side panels are not easily accessible for welding the same to said external sidewall of the vessel. Additionally, because of the fact that two welds are required to connect a bar rail reinforcing rim about the open peripheral edge of the vessel, structural stresses are created which frequently result in vessel distortion.

The objectionable features and shortcomings of the rolled rim and bar rail types of food processing vessel edge reinforcing structures are obviated in the design of a sanitary rail structure comprising the present invention, and a substantially improved food products storage and transfer vessel is provided which has an edge reinforcing and protective rail structure, the details of which are as follows.

SUMMARY OF THE INVENTION

It is the principal object of the present invention to provide a totally enclosed reinforcing and protective sanitary rail structure integral with the sidewall panels of a food products storage and transfer vessel, wherein said rail structure has a design configuration embodying openly exposed external surfaces in order to minimize the accumulation and collection thereon of food processing waste and contaminants, as well as providing a rail structure which is easily accessible for purposes of cleaning and maintaining sanitary conditions when said vessel is employed in any and all phases of food products processing operations, as well as facilitating welding the same to the sidewalls of the vessel.

It is an additional object of the present invention to provide a sanitary rail structure which furnishes a degree of stiffening and reinforcing to the open peripheral edge of a food products vessel which is at least equivalent, if not superior, to the rigidity and strength afforded by rail structures heretofore known.

It is another object of the present invention to provide a sanitary rail structure which has smooth continuous rounded edges and does not present a safety hazard to personnel during operational use of a food products vessel equipped with said improved rail structure.

A further object of the present invention is to provide a sanitary rail structure which requires only a single continuous welded joint along the longitudinal dimensions of the vessel to fabricate an enclosed sanitary construction, thereby minimizing vessel distortion effects otherwise normally encountered in the employment of a non-integral reinforcing rail member requiring attachment by means of multiple longitudinal joint welds in order to accomplish a totally enclosed rail structure of sanitary construction.

Yet another object of the present invention is to provide a sanitary rail structure which has an openly exposed and easily accessible longitudinal edge along which the welded joint is formed.

It is also an additional object of the present invention to provide a sanitary rail structure which is readily and easily formed by bending by employing standard metal working equipment and methods.

Details of the foregoing objects and of the invention, as well as other objects thereof, are set forth in the following specification and illustrated in the accompanying drawings comprising a part thereof.

DETAILED DESCRIPTION

Figure 1:
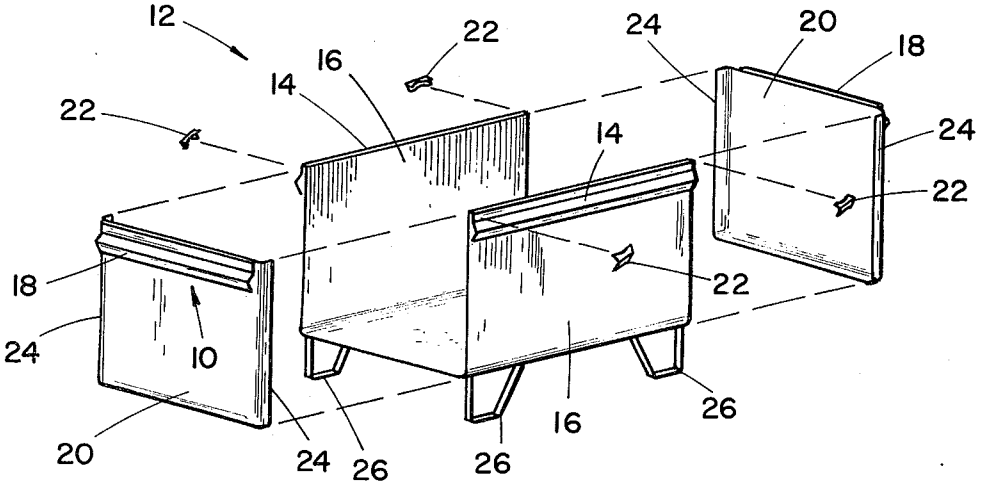
FIG. 1 is an exploded front perspective elevation view of the component members of an exemplary food storage and transfer vessel, showing also the component members of a sanitary rail structure assembly embodying the principles of the present invention.

Referring to FIG. 1, which shows the component parts of the present invention comprising a sanitary rail structure 10 for a food products storage and transfer vessel 12, wherein said sanitary rail structure 10 has included as components thereof side panel rail sections 14 which are integrally formed from the upper edge material of the respective side panel members 16 of vessel 12, end panel rail sections 18 which are integrally formed from the upper edge material of the respective end panel members 20 of vessel 12, and four rail section corner members 22 which integrally connect the side and end panel rail sections at the corner locations. It should be noted that each of the respective end panel members 20 has radially formed inward facing edge flanges 24 on the sides and bottom edges thereof to provide connection edges for connection to the ends of the bottom and side panel members 16 of vessel 12.

Also, as illustrated in FIG. 1, the vessel 12, if desired, may be provided with so-called "skid legs" 26 which serve to elevate the bottom of said vessel above the floor, as well as additionally serving to provide retaining guides for fork lift tongs in the event vessel 12 is to be moved by means of a fork lift vehicle. It is, however, to be understood that said vessel 12 could be alternately provided with suitable wheels, casters or skid rails for purposes of mobility, and the illustration of a vessel 12 equipped with skid legs 26 is exemplary only.

Figure 2:
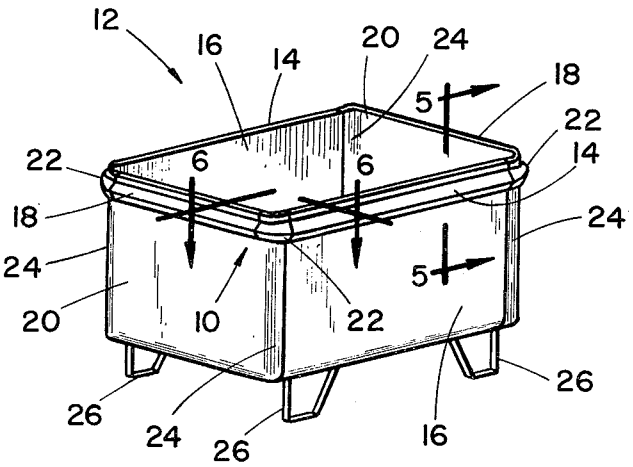
FIG. 2 is a front perspective elevation view of an assembled exemplary food vessel as seen in FIG. 1, showing also a sanitary rail structure formed thereon.

The view shown in FIG. 2 illustrates an assembled food products vessel 12 equipped with the sanitary rail structure 10, the respective side and end panel rail sections 14 and 18 of said rail structure 10 being shown integrally connected at the ends thereof to rail section corner members 22 by weldments, whereby said corner members and said side and end panel rail sections 14 and 18 are continuous with each other. More specific descriptions of the welded assembly of the component parts of said rail structure 10, as well as the sanitary assembly of said rail structure to the side and end panels of the food products vessel 12, will hereinafter be set forth in the description of FIGS. 5 and 6.

The sanitary rail structure assembly 10 as disclosed in FIGS. 1 and 2 is preferably constructed of the same material as the food products vessel 12 to which it is affixed, the preferred material thereof being metal, but any other suitable material may be used.

Figure 4:
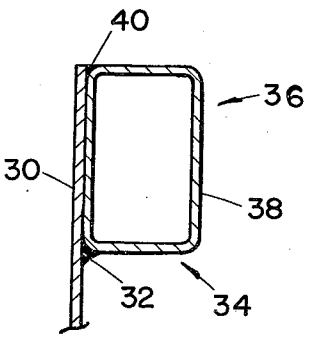
PRIOR ART FIG. 4
FIG. 4 is an enlarged sectional elevation of yet another exemplary prior art food vessel rail structure.
Figure 3:
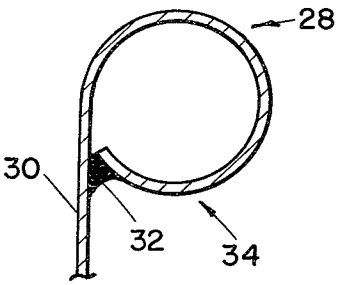
PRIOR ART FIG. 3
FIG. 3 is an enlarged sectional elevation of an exemplary prior art food vessel rail structure.

The views shown in FIGS. 3 and 4 respectively illustrate fragmentary enlarged sectional elevations of the two general types of food products vessel reinforcing rail structures heretofore known, wherein the view in FIG. 3 represents an exemplary illustration of the so-called "closed rolled rim" type, and the view shown in FIG. 4 represents an exemplary illustration of the so-called "bar rail" type.

Referring to FIG. 3 to consider in more detail the closed rolled rim type of sanitary rail structure therein illustrated, it will be noted that the closed rolled rim rail structure 28 is integrally formed from the exemplary side-wall 30 of a conventional food products vessel by means of bending the upper edge of the panel 30 into a tubular configured rail in accordance with metal working methods well known in the art. After the tubular rail member is thus formed, the free edge thereof is integrally affixed to the external surface of the exemplary sidewall 30 of said vessel by means of a connecting fillet type weldment 32, as illustrated in FIG. 3, thereby providing a closed, continuous reinforcing rim member about the upper open peripheral edge of said vessel.

It will be noted from FIG. 3, however, that the under surface area 34 of the closed rolled rim rail structure provides a narrow surface or channel conducive to the collection and accumulation of food processing waste and contaminants, which surface area is not easily accessible for purposes of cleaning, thereby creating an inherent unsanitary rail structure condition. It will likewise be noted that the area for applying the fillet type weldment 32 also is not easily accessible for welding operations, and, in the event that said fillet weldment should become cracked during use of said vessel, an unacceptable unsanitary crevice will be formed in which food processing waste and contaminants can collect, and it will be seen that said condition would not be readily detectable due to the recessed and hidden location thereof.

Referring now to FIG. 4 to consider in greater detail the other type of food products processing vessel rail structure design which is in current general use, the illustrated bar rail structure 36, is comprised of a section of rectangular shaped tube stock 38 which is coextensive in length with periphery of said vessel, is welded to the upper external surface of the exemplary sidewall 30 of said vessel. It will be noted that two connecting weldments are required to affix the bar rail type reinforcing rim assembly to the sidewalls 30 in order to provide a closed rail of sanitary construction. The first weldment 40 connects and fills any space between the upper peripheral edge of the exemplary sidewall 30 and the upper and inner corner of the bar rail. The second weldment 32 connects the lower inner corner of the bar rail to the external sidewall 30 of the vessel. The bar rail structure thus requires two longitudinal peripheral weldments in order to provide a closed, continuous reinforcing rim member about the open peripheral edge of a food products vessel and this frequently results in the creation of structural stresses which, in turn, cause undesirable vessel distortion.

As was also the situation with the closed rolled rim rail structure 28, the bar rail structure 36 likewise provides an under surface area 34 which is conducive to the collection and accumulation of food processing contaminants and said under surface area is not easily accessible for purposes of cleaning the same, thereby also creating an inherent unsanitary rail structure condition. Further, the region for applying the weldment 32 is not easily accessible either for welding or inspection. Thus, in the event that said fillet weldment should become cracked during use of said vessel, an unacceptable unsanitary crevice would be formed in which food processing waste and contaminants could collect and said condition would not be readily detectable due to the recessed and hidden location thereof.

The aformentioned inherent unsatisfactory unsanitary condition characteristics of both the closed rolled rim rail structure 28 and the bar rail structure 36 described above are obviated by a sanitary rail structure exemplified by the present invention, details of which are described as follows.

Figure 5:
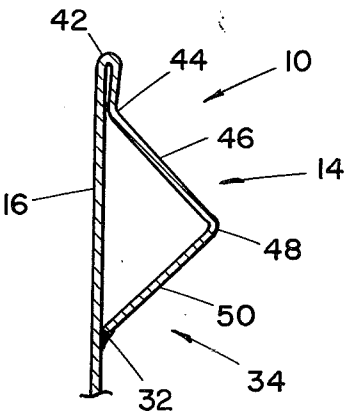
FIG. 5 is an enlarged sectional elevation of the sanitary rail structure of the present invention as seen along the line 5—5 of FIG. 2.

Referring to FIG. 5 which illustrates the sanitary rail structure 10 comprising the present invention, it will be seen from a comparison of the sectional elevation of the sanitary rail structure 10 comprising the present invention with the sectional elevations of the exemplary prior art rail structures as respectively shown in FIGS. 3 and 4, that the present invention comprises a rail structure embodying a fully exposed external profile configuration, which provides a more readily cleaned and sanitary construction easily capable of inspection. The sanitary rail structure 10 of the present invention is integral with the upper open peripheral edge portion 16 of the sidewall panel member of a food products processing vessel otherwise shown in FIGS. 1 and 2. The improved rail 10 is formed by bending the upper edge portion of the side panels 14 and end panels 16 into a geometric configuration by metal working methods well known in the art.

Said rail 10 comprises a reverse bend to provide a hairpin-shaped smooth edge rim member 42 which constitutes a closed reinforcing double-wall thickness of vessel sidewall material along the upper peripheral edge of the panel member 16. An angular bend 44 is made in the depending sidewall material external to the panel member 16, to form the angularly outwardly and downwardly sloping sanitary rail panel or strip 46. An angular bend 48 is made at the lower edge of panel 46 to complete the sanitary rail structure by providing an angularly inward extending rail panel 50, the terminal edge of which is integrally affixed by welding to the external surface of panel member 16, as shown at 32. This arrangement comprises a closed continuous reinforcing rim member along the upper peripheral edge of the vessel panel member 16. It will be particularly noted that the under surface area 34 of the sanitary type rail structure 10 is fully exposed to provide easy access for cleaning and maintaining a sanitary condition, as well as the fact that the line of the weldment 32 is easily accessible to form the same in addition to being readily visible for purposes of inspection, all of which provides improved sanitary features over the prior art food vessel reinforcing rail structures heretofore discussed described and illustrated in FIGS. 3 and 4.

Figure 6:
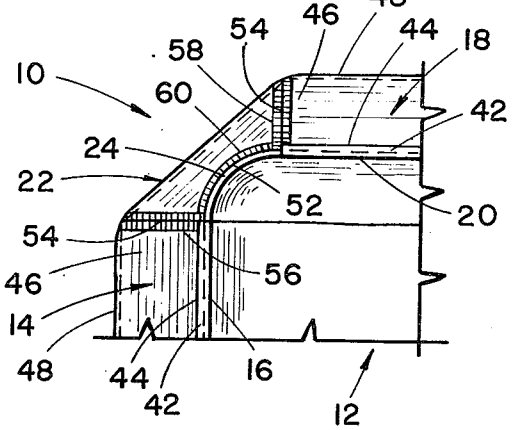
FIG. 6 is an enlarged top plan view of an installed sanitary corner connecting and enclosing member for the rail structure as seen along the line 6—6 of FIG. 2.

Referring to FIG. 6, which is an enlarged top plan view illustrating the means of connecting a rail section corner member 22 in order to provide a completely closed continuous reinforcing rim member about the open peripheral upper edge of a food products vessel 12, the corner member 22 has a somewhat triangular shape in plan view with upper and lower leg dimensions thereof corresponding in shape with the shapes and dimensions of the ends of the rail sections on the side and end panels 16 and 20 of said sanitary rail structure 10. The corner section legs are further provided with a set of upper and lower radial concaved edges 52 corresponding to the radius of exterior curvature of the radially formed curved flanges 24 on the opposite edges of end panels 16. The outer ends 54 of the corner members 22 are cut to fit and form a close-fitting connection when respectively affixed by weldments 56 to the ends of rail sections 14 and 18. Fillet weldments 60 integrally affix the respective upper and lower radial edge surfaces 52 of said corner members 22 to the radially formed exterior surfaces of curved flanges 24 of the end panel members, thereby forming a completely closed reinforcing rail system around all sides and ends of the food products vessel 12.

While the invention has been described and illustrated in its several preferred embodiments, it should be understood that the invention is not to be limited to the precise details herein illustrated and described since the same may be carried out in other ways falling within the scope of the invention as illustrated and described.

We claim:

1. A longitudinal sheet metal food vessel comprised of a U-shaped first member having a planar bottom and a pair of laterally disposed vertically extending planar side panels of similar height wherein each of said side panels is integrally formed from the material of said bottom respectively through the curvature of a relatively short radius 90° bend made at the respective lateral limits of said bottom and having also as second members a respective pair of non-integral generally planar end panels of said similar height and otherwise corresponding in complementary geometrical configuration to the opposite longitudinal ends of said U-shaped first member by each of said end panels having respectively integral thereto a flush plurality of flange edges comprised of an inwardly bent bottom flange and a corresponding pair of respective inwardly bent side flanges integrally joined to said bottom flange thereof by respectively formed quarter-hemisphere end panel bottom corner flanges wherein the curvature of all of said end panel bends are complementary to said relatively short radius 90° bend and wherein also each of said second member panels are thereafter weldably connected along said flush plurality of flange edges thereof to the respective longitudinal side, bottom, and corner ends of said U-shaped first member to form an open top container having corners which are curved upon said relatively short radius 90° bend in cross section, in combination with reinforcing means integral to the upper edges of said side and end panels comprising the upper edge portions of said side and end panels being of uniform width and bent to provide an outermost relatively narrow strip integrally connected along one edge by a substantially right angle bend to one edge of an intermediate strip and the opposite edge of said intermediate strip being connected integrally by a bend in excess of a right angle to one edge of a connection strip integrally connected to the upper edges of said side and end panels at the other edge thereof by a reverse bend to dispose said connecting strip in flatly overlying relationship with the exterior surface of the upper edge portions of said side and end panels, continuous weldment affixing means fixedly attaching the outermost edge of said outermost narrow strips of said reinforcing means to said exterior surface of each of said side and end panels, means enclosably connecting the corner ends of said reinforcing means, said corner enclosing connected means being comprised of respective unitary complementary configured sheet metal corner members having the lateral upper and lower connecting edge portions thereof configured in complementary shape to the exterior curvature of said relatively short radius 90° bend of said corners of said vessel and the longitudinal end connecting edge portions thereof configured in complementary shape to the respective terminal corner ends of said reinforcing means and respectively affixed to the exterior surfaces of said corners and the respective terminal ends of said reinforcing means by continuous weldments, thereby providing an enclosed rail-like reinforcing configuration having a substantially triangular shape in cross-section extending longitudinally along all side and end panels of said vessel in limited spaced relation to the upper edges thereof to provide readily inspected and repairable surfaces which are easy to clean.

* * * * *